United States Patent [19]

Herrmann

[11] Patent Number: 4,953,324

[45] Date of Patent: Sep. 4, 1990

[54] PERSONNEL DOOR FOR A RF SHIELDED ROOM

[75] Inventor: Karl H. Herrmann, Seattle, Wash.

[73] Assignee: Nova-Tech Engineering, Inc., Edmonds, Wash.

[21] Appl. No.: 330,828

[22] Filed: Mar. 30, 1989

Related U.S. Application Data

[63] Continuation of Ser. No. 129,490, Dec. 7, 1987, abandoned.

[51] Int. Cl.[5] ..... E05F 7/02

[52] U.S. Cl. ..... 49/255; 49/258; 49/477; 174/35 MS

[58] Field of Search ..... 49/255, 256, 258, 477, 49/190, 156; 174/35 MS

[56] References Cited

U.S. PATENT DOCUMENTS

| | | | |
|---|---|---|---|
| 1,775,681 | 9/1930 | Morino | 49/256 |
| 2,113,677 | 4/1938 | Carroll | 49/256 |
| 3,346,992 | 10/1967 | Lodge | 49/255 |
| 3,820,282 | 6/1974 | Korylak | 49/255 |
| 4,370,831 | 2/1983 | Hamilton | 49/477 |

FOREIGN PATENT DOCUMENTS

| | | | |
|---|---|---|---|
| 2329263 | 12/1974 | Fed. Rep. of Germany | 49/255 |
| 519066 | 3/1940 | United Kingdom | 49/255 |

*Primary Examiner*—James R. Brittain

*Attorney, Agent, or Firm*—Mark Zovko

[57] ABSTRACT

A personnel door for sealing a room having a source of Radio Frequency (RF) radiation. The door when swung into a closed position can be energized to be partially disposed in an opening below floor level directly beneath the door. Sealing between the door and the door frame of the room can occur around the borders of the door including the part disposed in the opening below floor level. A step up into the room or use of a ramp to gain access to the room is thereby eliminated. In the preferred embodiment, the door is retained above the opening below floor level by springs and energized to move vertically downward into the opening against the force of the springs by an air cylinder.

15 Claims, 4 Drawing Sheets

PERSONNEL DOOR FOR A RF SHIELDED ROOM

CROSS RELATION TO OTHER APPLICATIONS

This application is a continuation of my co-pending application Ser. No. 7/129,490 filed 12/7/87, abandoned.

BACKGROUND OF THE INVENTION

1. Field of the Invention

This invention relates in general to radio frequency (RF) shielding for a room and more particularly to a personnel swing door sealing system which eliminates the need for a step or ramp at the entrance to the room.

2. Discussion of the Prior Art

In general it is necessary to provide shielding at any apertures of a room having a significant source of RF radiation. Alternatively, in certain applications, the room will need to be shielded from an outside RF source. Such shielded rooms are used, for example, for circuit testing for RF emission tests, for housing certain computer installations, etc. A shielded room of the type to which the present invention is directed is usually a specially made enclosure and is of sufficient size to permit passage of workmen and technicians therethrough. A primary problem with construction of such a shielded enclosure is to provide a personnel access door which will completely seal against electromagnetic radiation leakage while affording the least obstruction to personnel passage therethrough.

The above described rooms having a source of RF radiation require effective sealing systems around all openings to avoid leakage of electromagnetic radiation. In the present art, shielding around a personnel door is provided by a series of shielding plates fixed around the border of the door. The shielding plates are metallic and to minimize RF leakage contact the door frame of the aperture or the wall of the shielded room all around the personnel door. A typical example of a RF shielded door seal can be found in U.S. Pat. No. 4,370,831 issued to Hamilton. Obviously a "step" above floor level is required to gain access into the shielded room if the door is a swing type door as its bottom must be sealed against the door frame or wall to provide acceptable sealing. If the door were to extend all the way to the floor and no sealing surface counter to the lower part of the door were provided, ineffective shielding would result with gross leaking of electromagnetic radiation. The present art, therefore, requires that the personnel access aperture of a swing door not extend to floor level. A surface counter to the door must be provided all the way around the borders of the door to effect a positive RF seal. This requirement results in a "step" above floor level at the personnel access aperture which provides an obstruction of facile passage of personnel and equipment therethrough. The step can be hidden by a ramp on one or both sides of the access aperture, however, the ramp is obviously a hindrance relative to free access to the room. It is therefore highly desirable to provide a personnel swing door which suitably seals against RF radiation leakage and does not have any obstructions to traffic flowing in or out. It should be noted that the "step" can be eliminated if the door is a sliding type door with a track set below the floor opening. This type of door, however, requires more space and is generally more expensive than a swing door. The present invention eliminates the foresaid problems and improves upon the present art as will become evident from the following summary of the invention.

SUMMARY OF THE INVENTION

The present invention generally is a sealing system to prevent RF radiation leakage to or from a room having an access aperture and personnel swing door extending to the floor of the room. The system has a door leaf for covering the access aperture. To avoid having a step up to the access aperture when the door leaf is open, the system includes an opening set below floor level directly under the door leaf and outside of the access aperture. A door frame having a top portion located at the borders of the access aperture, and a bottom portion disposed in the opening below floor level is provided. The door leaf and door frame are connected by slidable connecting means which preferably is a sliding hinge attached to the door leaf and door frame. The slidable hinge allows vertical movement of the door leaf within a predetermined range relative to the door frame while allowing the door leaf to pivot relative to the door frame. Retaining means is provided which retains the door leaf in a first position above the opening below floor level when the door leaf is in a closed position relative to the access aperture. To seal the access aperture, the system has energizing means used to overcome the retaining means and slide the door leaf vertically relative to the door frame to a second postion partially disposing the door leaf in the opening below floor level when the door leaf is in a closed position relative to the access aperture thereby aligning the borders of the door leaf with the top and bottom portion of the door frame and sealing the access aperture.

In a preferred embodiment, holding means adjacent the door leaf and door frame is provided for maintaining the door leaf and door frame in sealing contact. The sealing contact preferably would extend around the borders of the door leaf and door frame. The most efficient way of providing a constant positive sealing contact between door leaf and door frame would be to use an inflatable seal well known in the art. Also in the preferred embodiment, the retaining means mentioned above would be a spring or set of springs retaining the door leaf in a position above the opening below floor level. Locking means can also be used to lock the door leaf in either the first position described above or in second position when it is in sealing contact with the door frame. The use of an air cylinder is an effective way to energize the door leaf from the first to the second position or from the second to the first position. As well known in the art, the door leaf would have a sealing section or series of sealing plates attached thereto which would contact a sealing surface of the door fame to perform the sealing function between the door leaf and door frame.

It is an object of the present inventon to provide a personnel door for a room having a source of RF radiation which provides an effective radiation seal between the room and the environment.

Another object of the present invention is to provide a sealing system for a RF radiation room using a swing door which eliminates the need for a ramp to obtain access through its personnel door.

A further object of the present invention is to provide a sealing system for an RF personnel swing door which does not require a step at the access opening.

Yet another object is to provide an RF facility personnel swing door which allows the personnel access aperture to extend to floor level.

These and other objects and advantages of the present invention will become more apparent from the following detailed description when taken in conjunction with the attached drawings.

DETAILED DESCRIPTION OF THE PREFERRED EMBODIMENT

Figure 1:
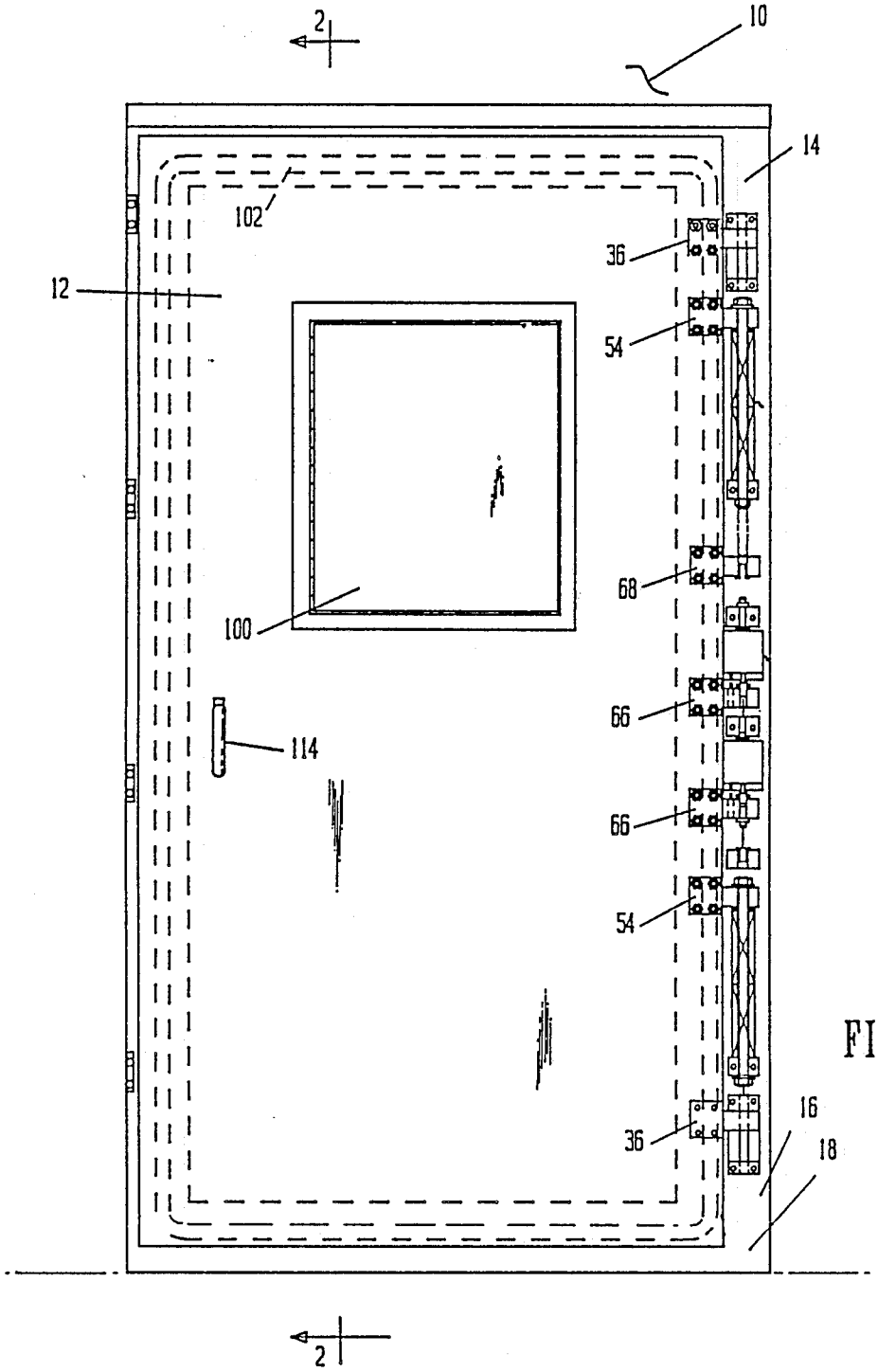
FIG. 1 is an elevation view directly in front of the door of the present invention.
Figure 2:
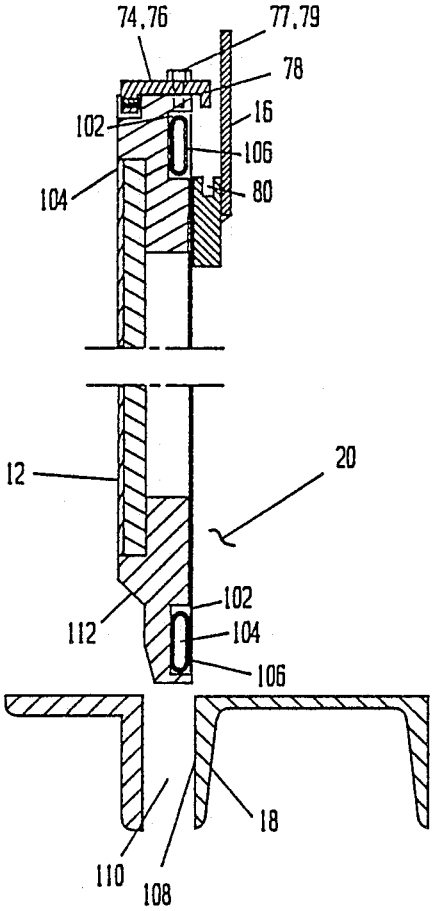
FIG. 2 is a sectional view through line 2—2 of FIG. 1 showing the door in a first position prior to the door being pushed down to a fully closed position.
Figure 3:
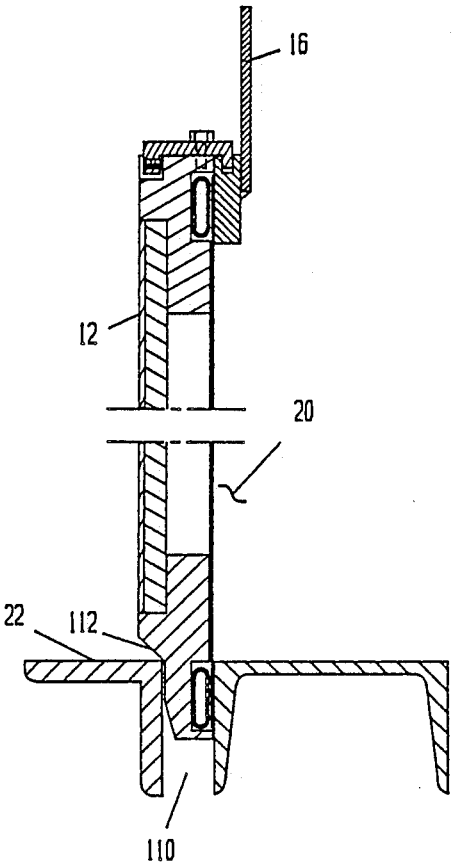
FIG. 3 is a sectional view similar to FIG. 2 but showing the door in a second position pushed down to a fully closed position.
Figure 4:
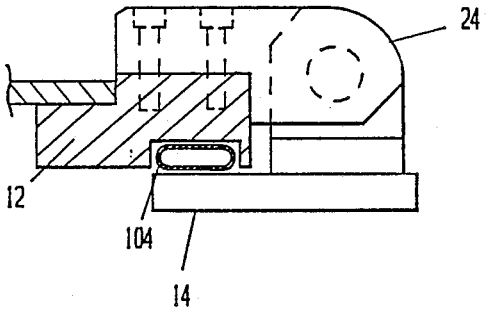
FIG. 4 is a plan view partially in cross section through the corner of the swing door and door frame featuring the sliding hinge.

Referring to the Figures, the RF personnel door of the present invention can be described. FIG. 1 shows a RF personnel door assembly generally designated as 10 having a door leaf 12. Door leaf 12 is mounted on a door frame 14 having a top portion 16 around the door leaf 12 above floor level and a bottom portion 18 below floor level. Door leaf 12 is immediately exterior to a room having a source of RF radiation (not shown) which has an access aperature or opening 20 as best seen in FIGS. 2 and 3. The access aperature 20 extends down to floor 22, and is bounded on its upper border by the top portion 16 of door frame 14. In actual practice, an access aperature of seven feet in height is a desirable opening size although other height dimensions can be used which are suitable for the individual application. Door leaf 12 is hinged to the top portion 16 of the door frame by sliding hinge assemblies 24 and 26. Sliding hinge assemblies 24 and 26 (see FIG. 5) are alike in structure having a bracket 28 fastened to the top portion 16 of the door frame. The bracket 28 has flanges 32*a* and 32*b* which have holes therethrough to receive a vertically disposed pin 34. Hinge assemblies 24 and 26 further consist of a bracket 36 fastened to the door leaf 12 having a flange 38 with a hole therethrough. The hole of flange 38 receives pin 34 and allows bracket 36 to be able to move vertically guided by pin 34. The door leaf 12 is therefore slidably connected to the door frame 14 in the vertical direction in that it is able to be moved up and down relative to door frame 14 while being secured thereto. The door leaf 12 can also pivot about hinge assemblies 24 and 26 allowing door leaf 12 to swing open and closed relative to access aperature 20.

Figure 5:
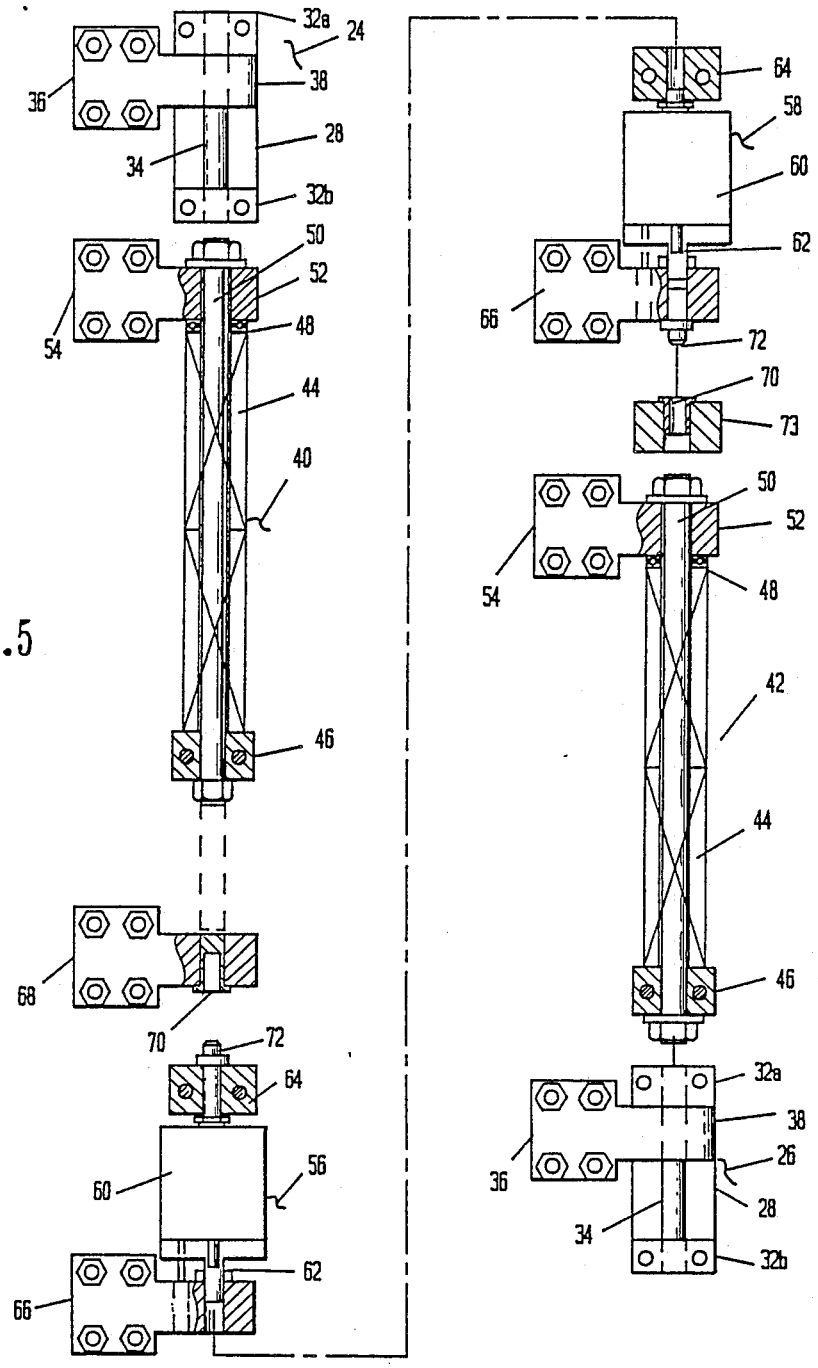
FIG. 5 is front elevation view showing the details of the attachment of the door leaf to the door frame.

Continuing with reference mainly to FIG. 5, the door assembly 10 has a pair of balancing spring assemblies 40 and 42. The purpose of the spring assemblies 40 and 42 is to retain the door leaf 12 in an "up" position as shown in FIG. 2 unless action is taken to move the door leaf 12 downward vertically. Spring assemblies 40 and 42 have like structure and the following description will apply to both. Assemblies 40 and 42 have a spring 44, the lower portion of which is disposed in a bracket 46 fastened to the door frame 14. The upper portion of spring 44 contacts a bearing surface 48 of a vertical member 50. Vertical member 50 is disposed in a hole of a flange 52 which is integral with bracket 54. Bracket 54 is fastened to door leaf 12. Spring 44 is compressed during operation and unless acted upon holds door leaf above the floor 22.

The RF personnel door assembly 10 has another key pair of assemblies, and they are air cylinder assemblies 56 and 58. These two assemblies are similar in structure and will be described below using one series of numerals, except where different. Air cylinder assemblies 56 and 58 contain a standard pneumatic air cylinder 60 well known in the conventional art. Air cylinder 60 has a rod 62. Rod 62 is shown in its unextended position in FIG. 1 and FIG. 5. The rod 62 when extended will push the door down as depicted in FIG. 3. Cylinder 60 is fastened to bracket 64 which is fastened to the door frame 14. The rod 62 is disposed in an opening in bracket 66 which is fixedly attached to the door leaf 12. Bracket 68 is fixed to door leaf 12 and has a slot 70 to receive a pin 72 when the rod 62 of assembly 56 is extended from air cylinder 60. Assembly 58 has a bracket 73 attached to doorframe 14 which receives the pin 72 of that assembly in a slot 70.

Figure 6:
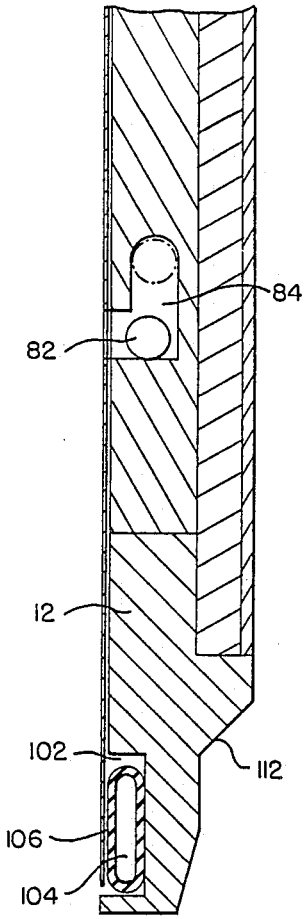
FIG. 6 is a side view of the door frame and door leaf of FIG. 1.

Now referring to FIG. 2, the door leaf 12 has a pair of top locking brackets 74 and 76 secured thereto. The brackets 74 and 76 are fixed to the door leaf 12 by bolts 77 and 79, respectively. A vertical flange 78 is located on brackets 74 and 76 on the side of the door leaf 12 nearest the door frame 14. The vertical flange 78 can engage a slot 80 in the door frame 14 when the door leaf is lowered to its down position. The top of the door leaf 12 is thereby secured and suitably held in place when the door leaf 12 is sealed. The side of the door leaf 12 opposite of the hinge assemblies 24 and 26 has a series of cam rollers fixed to the door frame 14. One of these cam rollers 82, as shown in FIG. 6, is disposed in the lower part of slot 84 in door leaf when the door leaf 12 is swung closed in the up position. The other three cam rollers are similarly disposed in like slots in door leaf 12. Slot 84 extends vertically and allow the cam roller 82 to fit in its upper part when the door leaf is energized to the down position as best shown in FIG. 6. The side of the door leaf opposite of hinge assemblies 24 and 26 can be suitably secured during sealing by the cam rollers and slots described above.

At this point, the door leaf 12 can be described further in detail. The door leaf 12 has a window 100 allowing visual access into the RF room. More importantly, the door leaf 12 has a cavity 102 close to its borders. Cavity 102 contains an inflatable air bladder 104 (FIG. 2) which when inflated serves to insure full contact between the RF shielding 106 of door leaf 12 and the inner sealing surface portion 108 of door frame 14. The RF shielding 106 consists of metal plates attached to the door leaf 12 as is conventional and well known in the prior art. The inner sealing surface portion of the door frame extends around the border of the door frame 14 including the top portion 16 and bottom portion 18 of door frame 14 and is contacted by RF shielding 106 when the door assembly is in sealing operation. Floor 22 has an opening 110 therein to receive the lower part of door leaf 12 when the door leaf 12 is energized downward. The sealing surface portion 108 of the lower portion 8 of door frame 14 is adjacent to the opening 110 on the inner side of door leaf 12. Door leaf 12 fits into the opening 110 until widened portion 112 of door leaf 12 contacts the edge of opening 110 as best shown in FIG. 3. As shown in FIG. 1, door leaf 12 has a door handle 114 for manually opening and closing the door leaf 12.

Operation of the RF personnel door assembly 10 can now be described. To seal the door leaf 12, an operator will manually swing the door leaf 12 closed relative to the access aperature 20. In the closed position, the plane of the door leaf 12 is parallel to the plane of the access aperature 20 and the door leaf 12 is directly adjacent to the access aperature 20 as shown in FIG. 2. At this point, the bladder 104 is deflated, the rod 62 of air cylinder 60 is in its unextended position and springs 44 are retaining the door leaf 12 in an "up" position undisposed in the floor opening 110. When the door is closed suitable activation means well known in the art such as a conventional limit switch (not shown) can initiate the extension of rod 62 of air cylinder 60. The door leaf 12 will move vertically downward until it is disposed partially in floor opening 110. At this point widened portion 112 of door leaf 12 will contact the edge of the floor opening 110. The door leaf 12 is further locked in position relative to the door frame 14 by the top locking brackets 74 and 76, the four cam rollers in slots 84 and the pins 72 engaging in the slots 70 of brackets 68 and 73. These locks hold the door leaf 12 in place relative to the door frame 14 so that when the air bladder 104 is inflated it will be able to force suitable sealing contact between the RF shielding 106 and the sealing surface portion 108. At this point the air bladder 104 can be inflated by conventional pressurizing means thereby pressing shielding 106 into contact with sealing surface portion 108 of the door frame 14. The door assembly 10 is therefore suitably sealed.

To open the door assembly 10, an operator desiring access to the RF room can activate the opening sequence by depressing a pushbutton on the door handle 100. This trigger will cause the bladder 104 to deflate by means well known in the art. Also, the air cylinder 60 can be caused to exhaust and the rod 62 to withdraw thereby allowing spring 44 to push the door leaf 12 upward vertically. Once the door leaf 12 is in the up position as shown in FIG. 2, the door can be swung open manually.

The invention may be embodied in other forms without departing from the spirit or essential characteristics thereof. The present embodiments are therefore to be considered in all respects as illustrative and not restrictive, the scope of the invention being indicated by the appended claims rather than the foregoing description, and all changes which come within the meaning and range of equivalency of claims are therefore intended to be embraced therein.

What I claim is:

1. A sealing system to prevent RF radiation leakage into or from a room having an access aperture extending to the floor of the room comprising a. a door leaf;

b. a floor;

c. an opening below floor level directly under said door leaf and outside of the access aperture;

d. a door frame having a top portion located at the borders of the access aperature, the door frame having a bottom portion disposed in said opening below floor level;

e. slidable hinging means attached to said door leaf and said door leaf and said door frame, said slidable hinging means allowing vertical movement of said door leaf relative to said door frame while allowing said door leaf to pivot relative to said door frame;

f. retaining means for retaining said door leaf in a first position above said opening below floor level when said door leaf is in a closed position relative to the access aperature;

g. energizing means for overcoming said retaining means and sliding said door leaf vertically relative to said door frame to a second position so as to partially dispose said door leaf in said opening below floor level and align the borders of said door leaf with the top and bottom portion of said door frame.

h. locking means which simultaneously locks said door leaf in a fixed position relative to said door frame as said door leaf is lowered to the second position partially disposed in said opening below floor level, said locking means including top locking means which locks the top of said door leaf and said door frame, said locking means further including first side locking means for locking the side of said door leaf having said slidable hinge means, said first side locking means independent of said slidable hinge means, and includes pin means attached to said door frame and adapted to be received by first slot means attached to said door leaf.

2. The apparatus of claim 1 which includes holding means adjacent said door leaf and said door frame for maintaining said door leaf and said door frame in contact.

3. The apparatus of claim 2 wherein said holding means extends around the borders of said door leaf and said door frame.

4. The apparatus of claim 1 wherein said top locking means includes bracket means attached to said door leaf and slot means in said door frame adapted to receive said brackets when said door leaf is in said second position.

5. The apparatus of claim 1 wherein said energizing means is an air cylinder.

6. A sealing system to prevent RF radiation leakage into or from a room having an access aperature extending to the floor of the room comprising a. a door leaf;

b. a floor;

c. an opening below floor level directly under said door leaf and outside of the access aperature;

d. a door frame having a top portion located at the borders of the access aperature, the door frame having a bottom portion disposed in said opening below floor level;

e. slidable hinging means attached to one side of said door leaf and said door frame, said slidable hinging means allowing vertical movement of said door leaf relative to said door frame while allowing said door leaf to pivot relative to said door frame;

f. retaining means for retaining said door leaf in a first position above said opening below floor level when said door leaf is in a closed position relative to the access aperature;

g. energizing means for overcoming said retaining means and sliding said door leaf vertically relative to said door frame to a second position so as to partially dispose said door leaf in said opening below floor level and align the borders of said door leaf with the top and bottom portion of said door frame;

h. locking means which simultaneously locks said door leaf in a fixed position relative to said door frame as said door leaf is lowered to in the second position partially disposed in said opening below floor level, said locking means including top locking means which locks the top of said door leaf and said door frame, said locking means including first side locking means for locking the side of said door leaf having said slidable hinge means, said first side locking means independent of said slidable hinge means and includes pin means attached to said door frame and adapted to be received by first slot means attached to said door leaf, said locking means further including second side locking means, said second side locking means including cam roller means fixed to said door frame and second slot means adapted to receive said cam roller means and lock the side of said door leaf opposite said slidable hinge means in a fixed position relative to said door frame when said door leaf is in said second position.

7. The apparatus of claim 6 which includes holding means adjacent said door leaf and said door frame for maintaining said door leaf and said door frame in sealing contract.

8. The apparatus of claim 7 wherein said holding means extends around the borders of said door leaf and said door frame.

9. The apparatus of claim 6 wherein said top locking means includes bracket means attached to said door leaf and slot means in said door frame adapted to receive said brackets when said door leaf is in said second position.

10. The apparatus of claim 6 wherein said energizing means is an air cylinder.

11. A sealing system to prevent RF radiation leakage into or from a room having an access aperature extending to the floor of the room comprising a. a door leaf;

b. a floor;

c. an opening below floor level directly under said door leaf and outside of the access aperature;

d. a door frame having a top portion located at the borders of the access aperature, the door frame having a bottom portion disposed in said opening below floor level;

e. slidable hinging means attached to said door leaf and said door frame, said slidable hinging means allowing vertical movement of said door leaf relative to said door frame while allowing said door leaf to pivot relative to said door frame;

f. retaining means for retaining said door leaf in a first position above said opening below floor level when said door leaf is in a closed position relative to the access aperature;

g. energizing means for overcoming said retaining means and sliding said door leaf vertically relative to said door frame to a second position so as to partially dispose said door leaf in said opening below floor level and align the borders of said door leaf with the top and bottom portion of said door frame.

h. locking means which locks said door leaf in a fixed position relative to said door frame as said door leaf is lowered to the second position partially disposed in said opening below floor level, said locking means including first side locking means for locking the side of said door leaf having said slidable hinge means, said first side locking means including pin means attached to said door frame and adapted to be received by first slot means attached to said door leaf.

12. The apparatus of claim 11 in which said locking means further includes second side locking means, said second side locking means including cam roller means fixed to said door frame and second slot means adapted to receive said cam roller means and lock the side of said door leaf opposite said slidable hinge means in a fixed position relative to said door frame when said door leaf is in said second position.

13. The apparatus of claim 12 which includes holding means adjacent said door leaf and said door frame for maintaining said door leaf and said door frame in contrast.

14. The apparatus of claim 13 wherein said holding means extends around the borders of said door leaf and said door frame.

15. The apparatus of claim 14 wherein said energizing means is an air cylinder.

* * * * *